US005430267A

United States Patent [19]

Ozeki et al.

[11] Patent Number: 5,430,267

[45] Date of Patent: Jul. 4, 1995

[54] KEYBOARD SWITCH

[75] Inventors: Kumio Ozeki; Fumio Watanabe; Haruo Yoshida; Yosuke Sakai, all of Tokyo, Japan

[73] Assignee: SMK Corporation, Tokyo, Japan

[21] Appl. No.: 160,432

[22] Filed: Dec. 1, 1993

[30] Foreign Application Priority Data

Dec. 2, 1992 [JP] Japan ..... 4-089503 U

[51] Int. Cl.[6] ..... H01H 13/06

[52] U.S. Cl. ..... 200/302.2; 200/341; 200/345; 200/302.1

[58] Field of Search ..... 200/302.2, 302.1, 520, 200/521, 530, 345, 523, 524, 525, 341, 342, 343

[56] References Cited

U.S. PATENT DOCUMENTS 4,806,908 2/1989 Krupnik ..... 200/302.2
5,145,058 9/1992 Lee ..... 200/530
5,306,886 4/1994 Yamada ..... 200/345

FOREIGN PATENT DOCUMENTS 3723163 3/1989 United Kingdom ..... 200/302.2

*Primary Examiner*—Henry J. Recla
*Assistant Examiner*—David J. Walczak
*Attorney, Agent, or Firm*—Vineet Kohli; Thomas R. Morrison

[57] ABSTRACT

In a keyboard switch that switches on and off by sliding a key stem, the key stem is slidably inserted in a key stem sleeve that is integral with the housing of the keyboard switch. The key stem comprises a sliding member integrally formed therewith and a keytop support whose shape is a wide flange formed integrally with and projecting outwardly from the outer periphery of the sliding member. An elastic hollow cylinder has one end hermetically joining the lower face of the keytop support and its other end hermetically joining the outer periphery of the key stem guide sleeve. With this structure, there can be no gap between the sliding member and the keytop support, so the interior of the keyboard switch is kept completely free from dust and moisture.

3 Claims, 3 Drawing Sheets

PRIOR ART

KEYBOARD SWITCH

BACKGROUND OF THE INVENTION

This invention relates to an improvement in the structure of a keyboard switch that functions as an input device for a point of sale ("POS") terminal, an electronic cash register ("ECR"), or the like.

A typical conventional keyboard switch in such a device comprises a single piece that combines a keyboard housing and a key stem guide sleeve. A key stem fits into the key stem guide sleeve. Depressing a keytop causes the key stem to slide downward. A keytop support joins the keytop to the key stem. The tip of a coil spring set inside the key stem becomes a movable contact that connects stationary contacts on a printed wiring board ("PWB").

Such a keyboard switch is vulnerable to the infiltration of dust or water through the gap between the inner surface of the key stem guide sleeve and the outer surface of the key stem. To eliminate this drawback, the present inventor proposed a novel keyboard switch (see Japanese Utility Model Application No. 74274/'91) in which a keytop support connects the keytop and the key stem. Two annular grooves, the first cut in the undersurface of the keytop support, the second cut around the key stem guide sleeve (which is integral with the keyboard housing), hold an elastic hollow cylinder under compression, thereby preventing dust or water from infiltrating into the key stem guide sleeve between the inner surface of the sleeve and the outer surface of the key stem.

This earlier-invented switch, however, still has a problem. Dust or water cannot be completely prevented from passing into the key stem guide sleeve through the gap between the key stem and the attaching portion of the keytop support, since the key stem and the keytop support are not integral. Rather they are separate parts that must be put together.

OBJECTS AND SUMMARY OF THE INVENTION

An object of the present invention is to provide a keyboard switch in which dust or water can be completely prevented from passing inside.

A further object of the present invention is to eliminate the passage of dust or water into a keyboard switch through the gap between the outer surface of the key stem and the inner surface of the key stem guide sleeve.

Still a further object of the present invention is to eliminate the passage of dust or water into a keyboard switch through the gap between the key stem and the attaching portion of the keytop support.

Briefly stated, the present invention provides, in a keyboard switch that switches on and off by sliding a key stem, that the key stem is slidably inserted in a key stem sleeve integral with the housing of the keyboard switch. The key stem comprises a sliding member formed integrally with the key stem and a keytop support whose shape is a wide flange formed integrally with and projecting outwardly from the outer periphery of the sliding member. An elastic hollow cylinder has one end hermetically joining the lower face of the keytop support and its other end hermetically joining the outer periphery of the key stem guide sleeve. With this structure, there can be no gap between the sliding member and the keytop support, so the interior of the keyboard switch is kept completely free from dust and moisture.

According to an embodiment of the invention, a keyboard switch comprises: a key stem guide sleeve made integral with a housing of the keyboard switch; a key stem slidably inserted in the key stem guide sleeve to perform a switching operation by a sliding motion of the key stem; the key stem further comprising: a sliding member slidably fitted in the key stem guide sleeve and a keytop support made integral with and projecting outwardly from an outer periphery of the sliding member; and an elastic hollow cylinder having a first end hermetically joining an undersurface of the keytop support and having a second end hermetically joining an outer periphery of the key stem guide sleeve.

According to a feature of the invention, a method of sealing a keyboard switch so that moisture and dust cannot enter internally, comprises: making a key stem guide sleeve integral with a housing of the keyboard switch; inserting a key stem into the key stem guide sleeve to perform a switching operation by a sliding motion of the key stem; forming the key stem from a sliding member slidably fitted in the key stem guide sleeve and a keytop support that is integral with and projects outwardly from an outer periphery of the sliding member; and hermetically joining a first end of an elastic hollow cylinder to an undersurface of the keytop support; and hermetically joining a second end of the elastic hollow cylinder to an outer periphery of the key stem guide sleeve.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 1(*b*) is a cross section of the keyboard switch shown in FIG. 1(*a*) viewed from the side.

DETAILED DESCRIPTION OF THE PREFERRED EMBODIMENT

Figure 3:
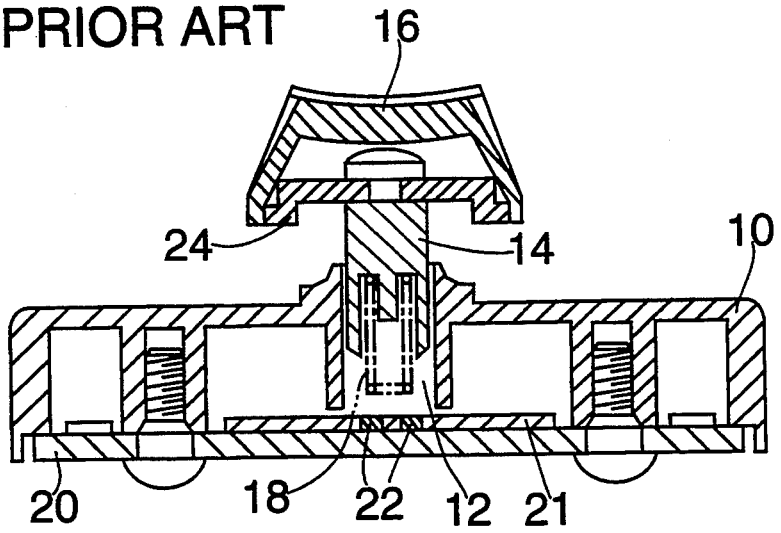
FIG. 3 PRIOR ART
FIG. 3 is a cross section of the principal part of a conventional keyboard switch viewed from the front.

Referring to FIG. 3, a keyboard housing 10 has a key stem guide sleeve 12 formed integrally with keyboard housing 10. A key stem 14 is slidably fitted into key stem guide sleeve 12. Depressing a keytop 16 causes key stem 14 to slide downward. The tip of a coil spring 18, engaged within key stem 14, is a movable contact that connects stationary contacts 22, 22 on a printed wiring board "PWB") 20. A keytop support 24 joins keytop 16 to key stem 14.

The keyboard switch of FIG. 3 is vulnerable to the infiltration of dust or water through the gap between the inner surface of key stem guide sleeve 12 and the outer surface of key stem 14. Dust or water that enters the inside of the keyboard switch can make it unreliable by shorting out stationary contacts 22, 22 or interfering with the dosing of the circuit between them by the tip of coil spring 18. Further, it can cause corrosion that reduces substantially the life of the keyboard switch.

Figure 4:
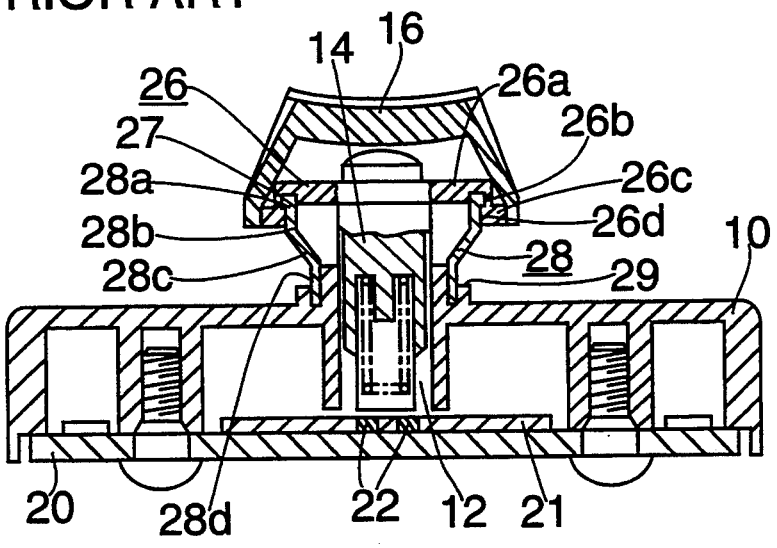
FIG. 4 is a cross section of the principal part of the keyboard switch of Japanese Utility Model Application No. 74274/'91 viewed from the front.

Referring to FIG. 4, in a prior-art improvement to the conventional keyboard switch of FIG. 3, a key stem 14 has a keytop support 26 that connects a keytop 16 and key stem 14. A first annular groove 27 is cut in the undersurface of keytop support 26. A second annular groove 29 is cut around a cylindrical extension at the top of key stem guide sleeve 12 that is integral with a keyboard housing 10. An elastic hollow cylinder 28 is held under compression between annular grooves 27 and 29, thereby preventing dust or water from infiltrating into key stem guide sleeve 12 between its inner surface and the outer surface of key stem 14.

Elastic hollow cylinder 28 is made of a material such as synthetic rubber. It consists of a large-diameter cylinder portion **28*b* with a small outer flange 28*a*, a tapering cylinder portion 28*c*, and a small-diameter cylinder portion 28*d*. Keytop support 26 consists of a disk 26*a* fixed to key stem 14 by a screw (or other fastening means), a short cylinder portion 26*b* formed integrally with disk 26*a* at the latter's circumference, and an outer flange 26*c* and an inner flange 26*d* formed integrally with short cylinder portion 26*b* at the latter's open end. A first annular groove 27 is cut in the undersurface of disk 26*a* along the inner surface of short cylinder portion 26*b*. One end of elastic hollow cylinder 28 is hermetically inserted into first annular groove 27. Outer flange 26*c* is fitted into cup-like keytop 16 to rigidly support it. Inner flange 26*d* catches outer flange 28*a* of elastic hollow cylinder 28 to secure the engagement between inner flange 26*d* and outer flange 28*a*. Dust or water cannot be completely prevented from passing through the gap between key stem 14 and the attached portion of keytop support 26 into key stem guide sleeve 12, since key stem 14 and keytop support 26** are separate parts that have to be put together. As they are not integral, a gap sufficient to pass dust or water therethrough will always exist, to the detriment of the life and reliability of the keyboard switch.

Figure 1A:
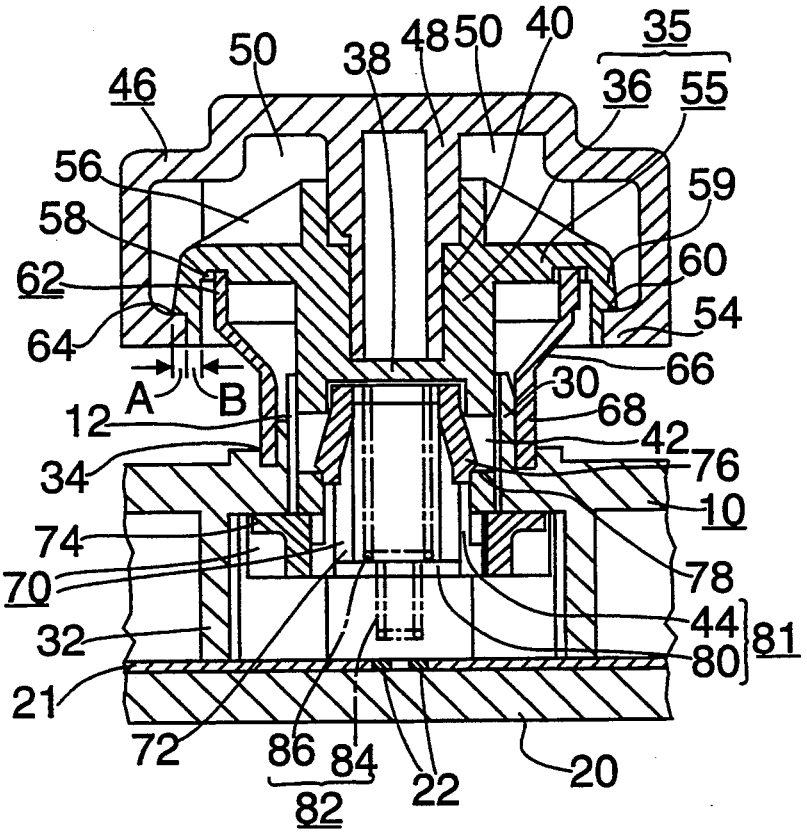
FIG. 1(*a*) is a cross section of an embodiment of the keyboard switch of the present invention viewed from the front.
Figure 1B:
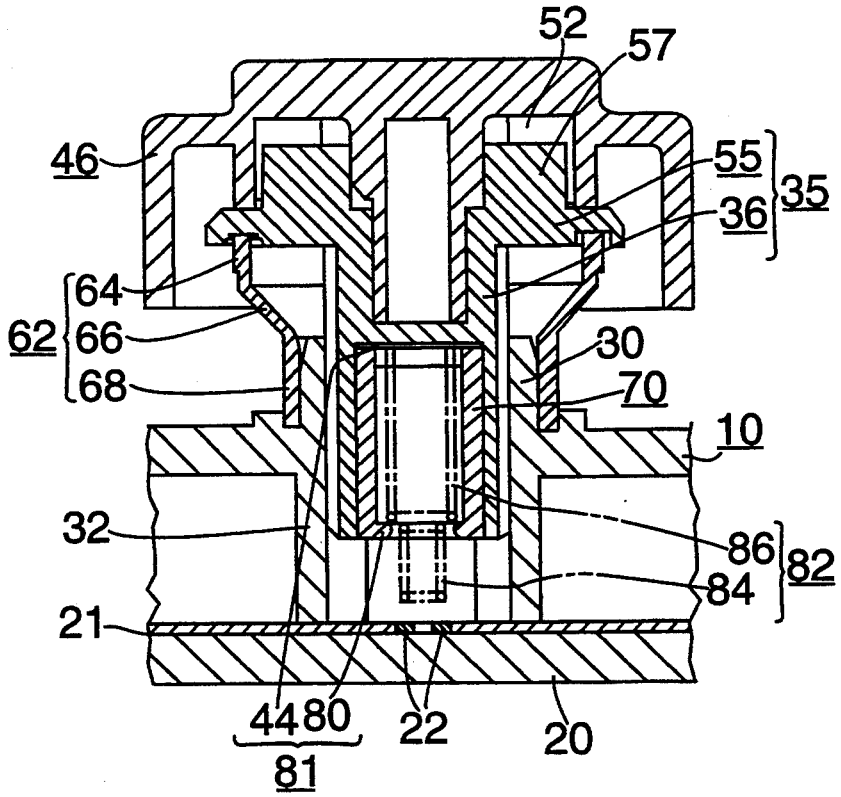

Referring to FIGS. 1(*a*) and 1(*b*), a keyboard housing 10, of molded synthetic resin, is formed integrally with key stem guide sleeve 12 comprising an upper guide sleeve (e.g., a guide cylinder) 30 extending upward, a lower guide sleeve 32 extending downward, and a through-hole. An annular groove 34 is cut around the outer periphery of upper guide sleeve 30. A key stem 35, of molded synthetic resin, comprises a sliding member 36 of nearly cylindrical form, slidably inserted into key stem guide sleeve 12, and a keytop support 55, with a wide flange integral with and projecting outward from the upper periphery of sliding member 36. A barrier 38 is integral to sliding member 36 and located at its center. An upper cavity 40, which has the shape of a cylinder on top of a square pillar, occupies the upper section of barrier 38. On the lower part of key stem 35 is a lower cavity 44 with windows 42, 42.

A keytop 46, of molded synthetic resin, has an integral shouldered shaft 48 in the center of its undersurface, press-fitted into upper cavity of 40 of sliding member 36. Keytop 46 also has guiding recesses 50, 50 and 52, 52 that prevent rotational motion. Keytop 46 is also integral with a pair of engaging jaws 54, 54 that project inwardly and are located diametrically along the lower periphery of keytop 46. The top portion of a keytop support 55 is integral with projections 56, 56 and 57, 57 (see FIG. 2) that fit into guiding recesses 50, 50 and 52, 52 to keep keytop 46 from rotating. An annular groove 58 is cut along the periphery of the undersurface of keytop support 55. Keytop support 55 is also integral with a pair of arms 59, 59 located diametrically and projecting downward. Interlocking steps 60, 60 are cut into the outer surfaces of the tips of arms 59, 59 to engage engaging jaws 54, 54 of keytop 46.

The depth A of engagement between engaging jaws 54, 54 and interlocking steps 60, 60 is chosen in relation to the force required to extract keytop 46 from key top support 55. The thickness B of the tip of each arm 59 is chosen to make the depth A equal to a predetermined value. A molding defect may cause a bend that makes depth A either larger or smaller than the predetermined value. If depth A is larger than the predetermined value, the force to extract keytop 46 becomes too large, making the extraction difficult. If depth A is smaller than the predetermined value, so that the force to extract keytop 46 becomes too small, keytop 46 will easily fall off keytop support 35. To prevent this from happening, the quantity A+B (i.e., the thickness of the tip portion of arm 59) must be constant. Since the required extraction force depends entirely on quantity A, it can be kept constant only by varying quantity B.

An elastic hollow cylinder 62 of molded synthetic rubber, similar to elastic hollow cylinder 28 of FIG. 4, has three integral sections. A large-diameter cylinder portion 64, fits snugly around a cylindrical extension on keytop support 55. A small-diameter cylinder portion 68 fits snugly around upper guide sleeve 30. A thin-walled tapering cylinder portion 66 lies between the two cylinder sections, joining them. The open end of large-diameter cylinder portion 64 hermetically joins annular groove 58 of keytop support 55, while the open end of small-diameter cylinder portion 68 hermetically joins annular groove 34 of the outer periphery of key stem guide sleeve 30.

A key stem stopper 70, of molded synthetic resin, consists of a hollow cylinder 72, slidably inserted in lower cavity 44, and a stopper base 74 integral with hollow cylinder 72. Hollow cylinder 72 has a pair of flaps 76, 76 cut open from its wall. The lower ends of flaps 76, 76 have stepped edges 78, 78 that engage the lower edges of windows 42, 42. The lower end of hollow cylinder 72 has inwardly projecting ledges that serve as spring retainers 80, 80. Spring retainers 80, 80 and lower cavity 44 constitute a spring holder 81. Stopper base 74 is prevented from rotating by contact with the side wall of lower guide sleeve 32 of housing 10.

A coil spring assembly 82 forms the movable switching member. Coil spring assembly 82 consists of a small-diameter coil spring. 84, with its lower end near stationary contacts 22, 22 on a flexible printed circuit ("FPC") 21, and a large-diameter coil spring 86, with its lower end connected continuously to the upper end of small-diameter coil spring 84. Spring holder. 81 keeps large-diameter coil spring 86 compressed at a constant pressure until the lower end of small-diameter coil spring 84 hits stationary contacts 22, 22. When the lower end of coil spring 84 hits contacts 22, 22, large-diameter coil spring 86 and small-diameter coil spring 84 are compressed. The compression of large-diameter coil spring 86 releases the force applied by large-diameter coil spring 86 on spring retainers 80, 80.

FPC 21 includes various printed circuits (not shown) to which stationary contacts 22, 22 are connected. FPC 21 is placed on PWB 20. Keyboard housing 10 is positioned above FPC 21 so that the lower end of small-diameter coil spring 84 is located directly above stationary contacts 22, 22.

To assemble the embodiment described above, the end of small-diameter cylinder portion 68 of elastic hollow cylinder 62 is fitted into annular groove 34 formed around upper guide sleeve 30 of housing 10. Sliding member 36 of key stem 35 is inserted from above into key stem guide sleeve 12. The end of large-diameter cylinder portion 64 of elastic hollow cylinder 62 is fitted into annular groove 58 of keytop support 55, which is integral with sliding member 36 pushing stopper 70 upward toward keytop support 55 until stepped Stopper 70 is assembled to the lower end of sliding member 36 by edges 78, 78 of flaps 76, 76 engage lower edges of windows 42, 42. At the same time, large-diameter coil spring 86 is held under compression in the hollow cylinder of stopper 70. The upper end of large-diameter coil spring 86 is urged against barrier 38 while the lower end, connected to small-diameter coil spring 84, is pushed up by ledge projections on spring retainer 80, 80 of stopper 70. Keytop 46 is then pressed down so that guided convexities 56, 56 and 57, 57 can be press-fitted into guiding recesses 50, 50 and 52, 52. Shouldered shaft 48 of keytop 46 can also be press-fitted into upper cavity 40 of sliding member 36.

Figure 2:
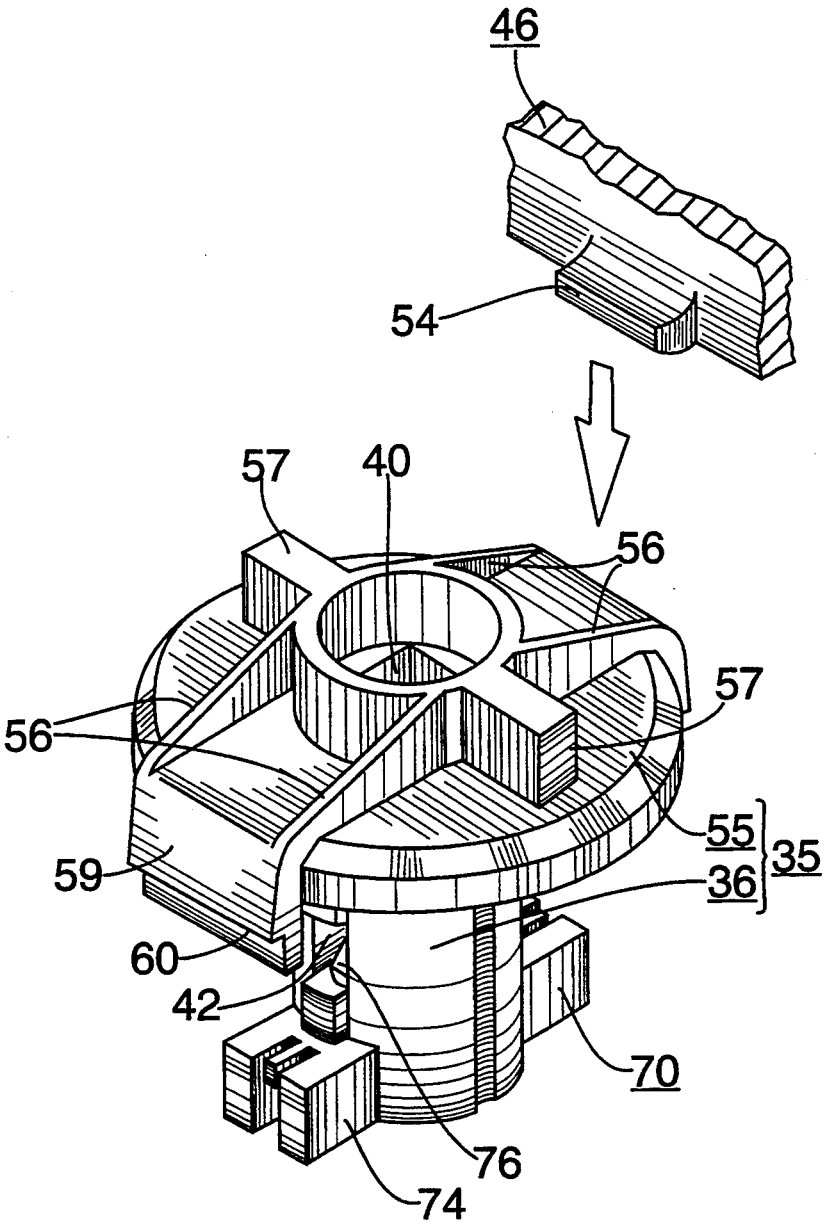
FIG. 2 is an enlarged perspective view of a principal part of the keyboard switch of FIG. 1.

Referring to FIG. 2, keytop 46 moves in the direction indicated by the arrow, and engaging jaws 54, 54 catch interlocking steps 60, 60 of arms 59, 59 of keytop support 55 to complete the assembly.

Referring again to FIGS. 1(*a*) and 1(*b*), the keyboard switch described above operates as follows. When sliding member 36 of key stem 35 is pushed down by depressing keytop 46, coil spring assembly 82 is also carried down, so the lower end of small-diameter coil spring 84, the movable contact, touches stationary contacts 22, 22 on FPC 21. This touching closes the circuit that includes the stationary contacts (i.e., the switch is turned on). Pressure from keytop support 55 (which is integral with sliding member 36) deforms elastic hollow cylinder 62.

Tapering cylinder portion 66 buckles when the pressure that turns on the switch exceeds the buckling load of tapering cylinder portion 66, so that a click touch is sensed through keytop 46. When the pressure on keytop 46 is released, the elastic forces of tapering cylinder portion 66 and coil spring assembly 82 restore keytop 46 to its initial position.

When keytop 46 is detached from key stem 35 for replacement, or when keytop 46 is depressed and released for switching, dust or water cannot get inside the keyboard switch. They cannot pass through the gap between sliding member 36 of key stem 35 and key stem guide sleeve 12, since elastic hollow cylinder 62 hermetically closes the gap by joining the end of large-diameter cylinder portion 64 to annular groove 58 of keytop support 55 and by joining the end of small-diameter cylinder portion 68 to annular groove 34 of housing 10. Further, as sliding member 36 of key stem 35 and keytop support 55 are integral, there is no gap between them through which dust or water can get inside the keyboard switch.

In the embodiment described above, this invention is applied to a keyboard switch where switching is performed by closing the stationary contacts on an FPC placed on a PWB, with the end of a coil spring serving as a movable contact. The present invention, however, is by no means limited to this application. This invention can also be applied to a keyboard switch that effects switching by moving a coil spring against a membrane switch disposed on a base plate and made by laminating a lower FPC with stationary contacts, a spacer, and an upper FPC with a movable contact. This invention can also be applied to a keyboard switch that effects switching by a movable contact other than a coil spring, such as electrically conducting rubber or a rod.

In the embodiment of this invention described above, to keep them simple, the elastic hollow cylinder and the keytop support do not have flanges to prevent easy or accidental detachment. These structures, however, are not only possible ones for this invention. For example, similar to the embodiment shown in FIG. 4, the end of large-diameter cylinder portion can have a flange while the end of short cylindrical portion of the disk of keytop support can have an inwardly extending flange, so that these two flanges can prevent easy or accidental detachment.

In another embodiment of this invention, the elastic hollow cylinder need not consist of large-diameter, tapering, and small-diameter cylinder portions. It may be of any form that hermetically seals the keytop support on one end and the outer periphery of the key stem guide sleeve on the other.

In the embodiment described above, the keytop support is a wide flange provided integrally with and projecting outwardly from the outer periphery of the sliding member. This, however, is not the only preferred structure of the keytop support. The keytop support can have any geometrical shape that is integral with and projects outwardly from the outer periphery of the sliding member and hermetically joins the end of the elastic hollow cylinder.

In a keyboard switch embodying the present invention, one end of the elastic hollow cylinder hermetically joins the undersurface of the keytop support while the other end of the elastic hollow cylinder hermetically joins the outer periphery of the key stem guide sleeve. Thus dust or water can be completely prevented from getting inside the keyboard switch through the gap between the sliding member of the key stem and the key stem guide sleeve. Also, as the key stem has a keytop support integrally formed with its sliding member, dust or water can be completely prevented from getting inside the keyboard switch through the gap between the sliding member of the key stem and the keytop support. Specifically, even when the keytop is removed for replacement, internal contamination by dust or water can be totally prevented by the integral form of the sliding member of the key stem and the keytop support, and the elastic hollow cylinder.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A keyboard switch comprising:

a key stem guide sleeve made integral with a housing of said keyboard switch;

a key stem slidably inserted in said key stem guide sleeve to perform a switching operation by a sliding motion of said key stem; said key stem further comprising:

a sliding member slidably fitted in said key stem guide sleeve;

a keytop support made integral with and projecting outwardly from an outer periphery of said sliding member;

a stopper;

a hollow cylinder portion into which said stopper is inserted;

said stopper including means for locking said stopper in said hollow cylinder; and means for preventing said key stem from rotating about an axis of said hollow cylinder; and an elastic hollow cylinder having a first end hermetically joining an undersurface of said keytop support and having a second end hermetically joining an outer periphery of said key stem guide sleeve.

2. A keyboard switch as in claim 1, wherein said means for locking includes:

a flap on said stopper;

means for urging said flap radially outward from said hollow cylinder axis; and an edge on said hollow cylinder for engaging an edge of said flap.

3. A keyboard switch as in claim 1, wherein said means for preventing includes:

an extension of said stopper;

said key stem guide sleeve having an internal surface; and said extension of said stopper engaging said internal surface.

* * * * *